US008816182B2

(12) United States Patent
Robertson

(10) Patent No.: US 8,816,182 B2
(45) Date of Patent: Aug. 26, 2014

(54) DIGITAL AUDIO CONNECTIONS FOR PORTABLE HANDHELD COMPUTING DEVICES

(76) Inventor: Kevin Arthur Robertson, Mountain View, CA (US)

( * ) Notice: Subject to any disclaimer, the term of this patent is extended or adjusted under 35 U.S.C. 154(b) by 237 days.

(21) Appl. No.: 13/039,243

(22) Filed: Mar. 2, 2011

(65) Prior Publication Data

US 2011/0146480 A1 Jun. 23, 2011

Related U.S. Application Data

(63) Continuation-in-part of application No. 12/565,334, filed on Sep. 23, 2009.

(60) Provisional application No. 61/143,786, filed on Jan. 10, 2009, provisional application No. 61/313,663, filed on Mar. 12, 2010.

(51) Int. Cl.

| | |
|---|---|
| ***G10H 3/00*** | (2006.01) |
| ***G10H 1/36*** | (2006.01) |
| ***G10H 3/18*** | (2006.01) |

(52) U.S. Cl.
CPC ..... *G10H 3/186* (2013.01); *G10H 1/361* (2013.01); *G10H 2230/015* (2013.01)
USPC ..... 84/723

(58) Field of Classification Search
USPC ..... 84/723, 615, 735; 381/118
See application file for complete search history.

(56) References Cited

U.S. PATENT DOCUMENTS

| | | | | |
|---|---|---|---|---|
| 7,129,872 | B1 * | 10/2006 | Qvortrup et al. | 341/139 |
| 7,678,985 | B2 * | 3/2010 | Adams et al. | 84/645 |
| 7,818,078 | B2 * | 10/2010 | Iriarte | 700/94 |
| 2007/0133825 | A1 * | 6/2007 | Waller, Jr. | 381/118 |
| 2011/0129207 | A1 * | 6/2011 | King et al. | 396/56 |

* cited by examiner

*Primary Examiner* — Jianchun Qin
(74) *Attorney, Agent, or Firm* — Carr & Ferrell LLP

(57) ABSTRACT

Systems and methods for processing a signal of an electric guitar are provided. An input guitar signal is received by a portable handheld computing device. The input guitar signal is processed using the digital signal. The combined guitar output is transmitted through the portable handheld computing device.

16 Claims, 7 Drawing Sheets

DIGITAL AUDIO CONNECTIONS FOR PORTABLE HANDHELD COMPUTING DEVICES

CROSS-REFERENCE TO RELATED APPLICATIONS

This application is a continuation-in-part and claims the priority benefit of U.S. patent application Ser. No. 12/565,334, titled "Processing Audio Signals with Portable Handheld Computing Devices" and filed Sep. 23, 2009, which claims the priority benefit of U.S. provisional application No. 61/143,786, titled "Guitar Amplifier and Audio Signal Processing Application for Portable Hand-Held Computing Devices" and filed Jan. 10, 2009. This application also claims the priority benefit of U.S. provisional application No. 61/313,663, titled "Digital Audio Connections for Portable Handheld Computing Devices" and filed Mar. 12, 2010. Each of the applications listed above are incorporated by reference herein.

BACKGROUND

1. Field of the Invention

This invention relates generally to signal processing equipment. The invention more specifically relates to digital audio connections for portable handheld computing devices.

2. Description of Related Art

An electric guitar requires amplification and effects processing to achieve the desired output sounds. The electric guitar, an amplifier, and processing effects work together as a single instrument. For that reason, many musicians desire a portable battery powered practice guitar amplifier that is light-weight, inexpensive, and may be transported in a clothing pocket or small hand bag. Currently, portable battery powered practice guitar amplifiers typically have low sound quality with limited features. Alternatively, such amplifiers are very expensive due to the computing hardware and advanced battery technology that are required for improved sound quality.

Portable handheld computing devices perform numerous entertainment and communication functions using high performance embedded computing hardware. The computing hardware required for these functions is significantly more expensive and more powerful than the hardware used by low cost battery powered practice guitar amplifiers that are currently available.

Ever changing designs in the construction of Smartphones make new connection and wiring configurations necessary for implementation of the invention.

SUMMARY OF THE INVENTION

Various embodiments of the technology described herein provide a software application executable on a computing device that amplifies and processes electrical guitar signals. Specifically, the electric guitar amplification and audio effects processing may be executed on a portable battery powered handheld computing device. The term "electric guitar" as used herein refers to all musical instruments that use an electrical pickup to transmit sound to an amplifying device. The software program may utilize many of the capabilities of portable computing devices designed for handheld battery powered operation, including but not limited to audio signal input, audio signal output, loudspeaker, central processing unit, random access memory, non-volatile storage memory, computer operating system, visual display, input capability, and means for installing and removing software applications.

Exemplary embodiments of this technology may use the above listed capabilities to perform a user-selectable and adjustable combination of audio signal processing effects for an electric guitar. The effects may include volume control, vacuum-tube-like distortion, tone control equalization, tone shaping, cabinet simulation, reverb, digital delay, chorus, flanger, phase-shifter, rotating loud-speaker, tremolo, dynamics compression, hum canceller, and noise gate.

Further aspects of the software program may allow users to interact with digitally encoded music files stored in nonvolatile memory in handheld computing devices. The program may mix digitally encoded music files with the digitally processed guitar signal, thereby providing an enhanced experience for practicing guitar by playing along with pre-recorded songs. Additionally, the program may use digitally encoded music files as a simulated guitar input to the audio signal processing functions, for the purpose of demonstrating the signal processing capabilities of the software application.

In order to provide a mechanism for the coupling of the guitar to the handheld computing device, exemplary embodiments of a novel audio coupling device are also disclosed herein. The audio coupling device may couple an electric guitar and, if desired, headphones, to a handheld computing device. The audio coupling device may be configured to mechanically couple the guitar and the handheld computing device without any instrument or audio cable adaptors.

DETAILED DESCRIPTION

The technology disclosed herein is a high performance software application for electric guitar amplification and audio effects processing. The application enhances the practicing experience by enabling amplification and signal processing using portable equipment. The application also enables the user to add optional effects to the guitar signal, and to mix the processed guitar signal with song titles stored in non-volatile storage memory in the portable handheld computing device. The application can also be demonstrated by using the stored song titles as simulated guitar input to the practice guitar amplifier software application.

The software application takes advantage of many of the capabilities of the host portable computing device. Host device capabilities utilized may include audio signal input, audio signal output, loudspeaker, a central processing unit, random access memory, non-volatile storage memory, computer operating system, visual display, input capability, and means for installing and removing software applications. It should be noted that due to certain limitations inherent in the handheld computing environment—relatively slow processing speeds, limited memory, and limited battery power—programming techniques not used for applications running in the typical PC/laptop environment must be utilized. Among these techniques are efficient audio sample block processing and fixed point mathematical computations.

The software application will typically be available via download from a server of an applications distributor. However, it should be noted that the software application can be stored and distributed via any computer-readable storage medium.

Figure 1:
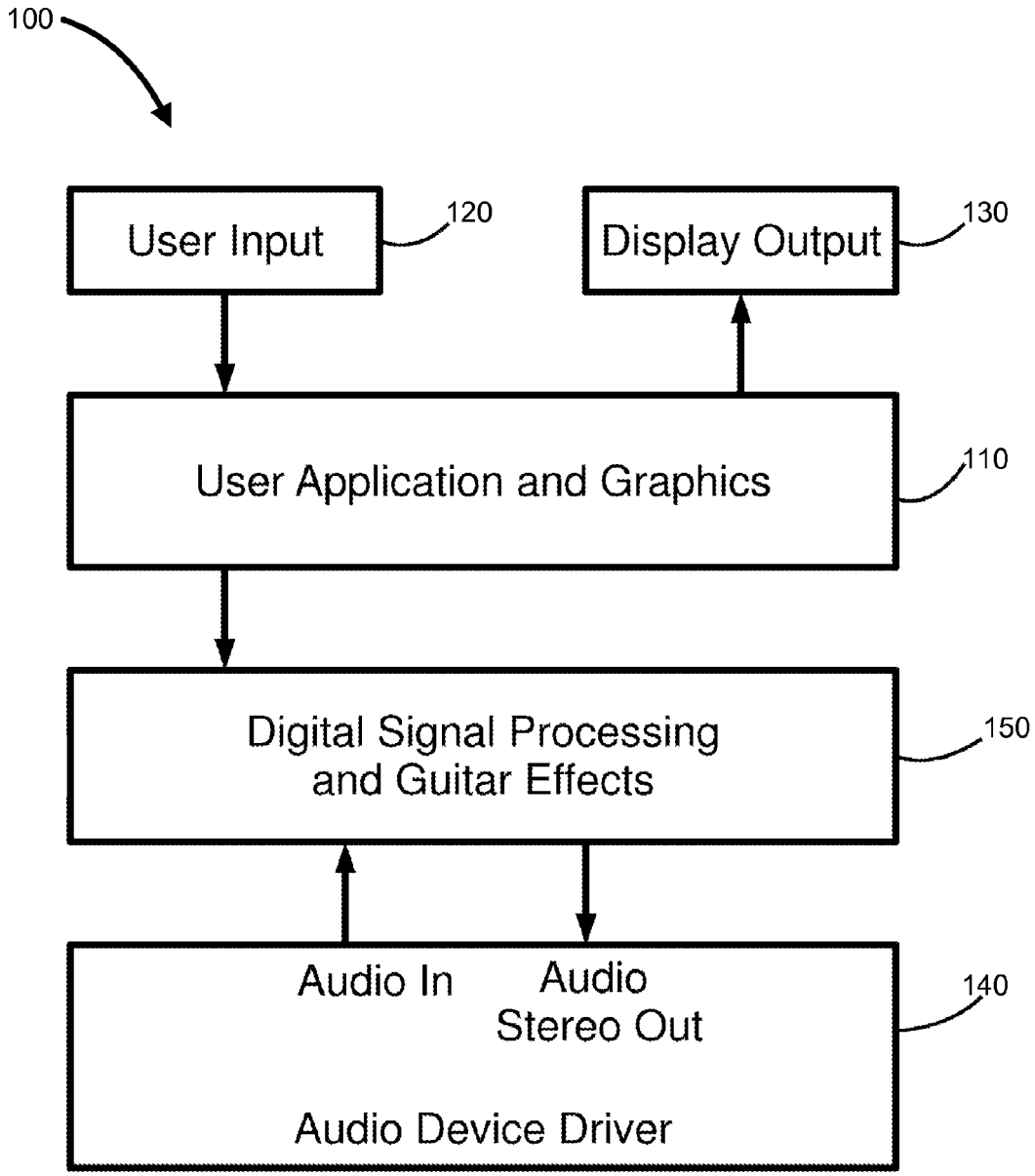
FIG. 1 is a block diagram of an exemplary embodiment of the controlling software for the guitar amplifier and audio signal processing application.

FIG. 1 shows one exemplary configuration of the software application 100 and software interfaces for the computing device that is utilized for electric guitar amplification and audio effects processing. The user application and graphics software 110 creates the look and feel of the practice guitar amplifier application. The user application and graphics software 110 displays the various selections and adjustments for the guitar signal processing effects that are available to the user. The user application and graphics software 110 interfaces with user input 120, and based on the selections input by the user, generates an appropriate display output 130.

The guitar amplifier software application may be supported by any type of platform of currently existing operating systems. The application interfaces, through user input 120, with the display output 130 of a host handheld computing device 510 (FIG. 5) to generate an appropriate visual display. In addition, the operating system platforms provide an audio device driver 140, which may be used to generate the audio output.

The signal received by the guitar amplifier software application 100 is processed in real time by the digital signal processing and guitar effects software block 150. The digital signal processing and guitar effects software block 150 adds those guitar effects selected by the user through the user input 120 and the user application and graphics software 110.

Figure 2:
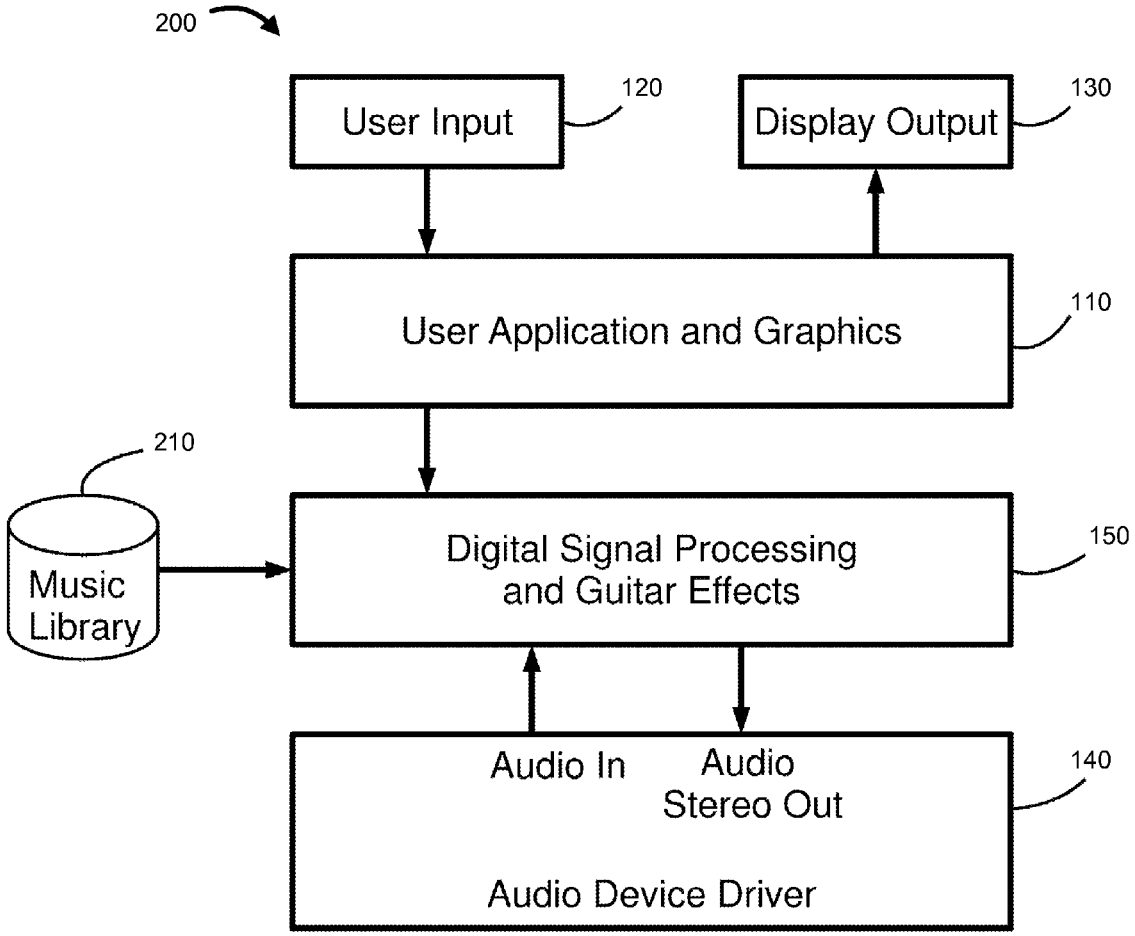
FIG. 2 is a block diagram of an exemplary embodiment of the controlling software for the guitar amplifier and audio signal processing application including a music library.
Figure 5:
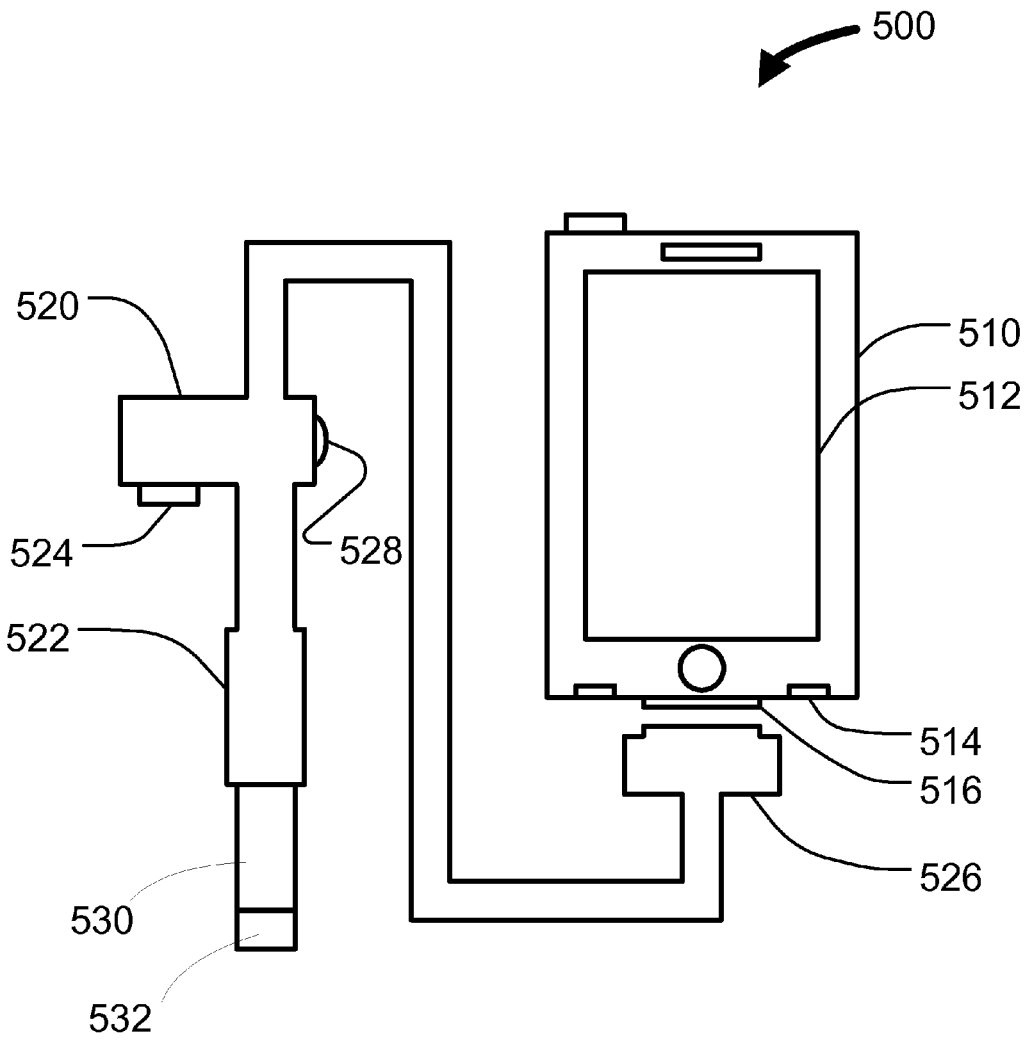
FIG. 5 illustrates a front view of an exemplary system for processing a signal from an electric guitar.

FIG. 2 illustrates an exemplary embodiment of the software application 200 that includes a music library 210. The music library 210 contains digitally encoded music files stored in the non-volatile storage memory of the handheld computing device 510 (FIG. 5). If the user so desires, background music from the music library 210 may be added to the guitar signal so that the user may play along with the pre-recorded background music.

After the input guitar signal is processed and mixed, the resultant signal (which is the combined signal output) may then be transmitted through the audio device driver 140 as the stereo sound output of the guitar. Thus, the digital signal processing and guitar effects software block 150 is in two-way communication with the audio device driver 140. The software block 150 receives the audio input signal that is generated by the guitar as input audio in, processes the guitar signal and adds effects and/or backup music, and finally transmits the resultant signal to the audio stereo output.

Figure 3:
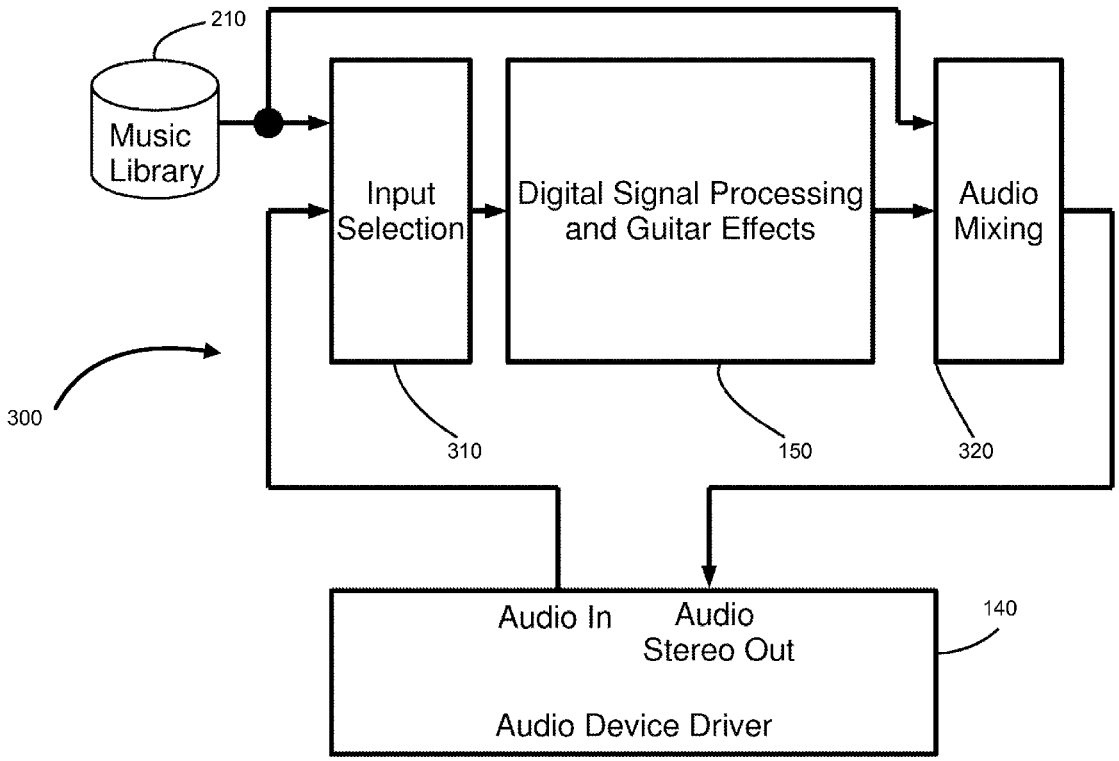
FIG. 3 is a software flowchart of an exemplary embodiment of the guitar amplifier including a depiction of the input selection and audio mixing functions.

FIG. 3 is a flow chart of the software application 300 depicting two different modes of operation for the digital signal processing and guitar effects software 150. During a normal practice session, the audio in (guitar input) from the audio device driver 140 is selected by the input selection block 310. The guitar signal is filtered in real-time by the digital signal processing and guitar effects software 150. The effects available from the processing and effects block 150 include at least volume control, vacuum-tube-like distortion, tone control equalization, tone shaping, cabinet simulation, reverb, digital delay, chorus, flanger, phase-shifter, rotating loud-speaker, tremolo, dynamics compression, hum canceller, noise gate, and any combination thereof.

The guitar signal output of the digital signal processing and guitar effects software 150 may be mixed in the audio mixing block 320 with pre-recorded music if the user has chosen a title from the music library 210. The resultant output signal of the audio mixing block 320 is then fed to the audio stereo out function of the audio device driver 140. The audio stereo out can then be accessed by the user either through a female stereo audio jack 524 (FIG. 5) or through the speakers 514 (FIG. 5) of the handheld portable computing device 510 (FIG. 5).

As demonstrated by the exemplary configuration shown in FIG. 3, the capabilities of the guitar amplifier software application 300 can be displayed even without a guitar input signal. To utilize the demonstration capability, the user inputs his choice of title stored in the music library 210. The input selection block 310 uses that selection to input the selected demonstration recording from the music library 210 to the digital signal processing and guitar effects software 150. This process thereby provides a simulated guitar input to the digital signal processing and guitar effects software 150, so that an effective demonstration of the guitar amplifier application 300 is provided, even though no actual guitar input is available from the audio driver 140.

Figure 4:
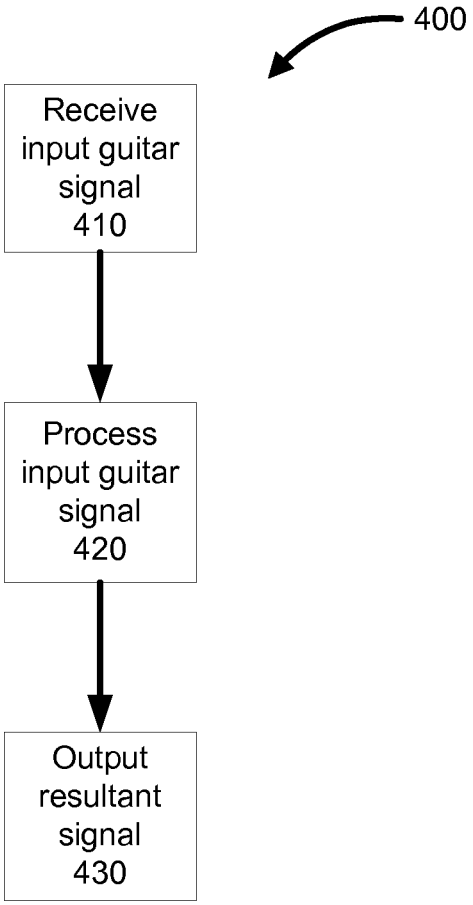
FIG. 4 is a flowchart illustrating an exemplary method of processing a signal from an electric guitar.

FIG. 4 is a flowchart illustrating a summary of an exemplary method 400 for processing an audio signal from an electric guitar. In initial step 410, an input guitar signal is received at an audio interface integrated circuit. The audio interface integrated circuit includes a mechanism to couple the audio interface integrated circuit to a portable handheld computing device. The coupling mechanism may include any methodology that allows the audio interface integrated circuit to transmit a signal to the handheld computing device.

In step 420, the input guitar signal may be processed to add user-selectable audio effects, which results in a combined signal output. The user may add any of several stored effects, or pre-recorded music from the music library 210. The processed signal is then transmitted in step 430 as the combined signal output. The software to accomplish the method will typically be downloaded directly to the user's computing device. The software application can be stored and distributed on any computer-readable storage medium.

Referring now to FIG. 5, an exemplary system 500 for processing an audio signal of a musical instrument utilizes, among other components, a processor of a portable battery powered handheld computing device 510 and an audio coupling cable 520. It should also be noted that while the audio coupling device is characterized herein as a cable, the device could also be constructed as a rigid element, a box or the like.

The representative portable handheld computing device 510 includes at least an input device 512 (typically a touch control display) that controls the functions of the computing device 510, at least one speaker 514, a processor, and a multi-function connector 516.

Significant challenges exist for executing an embodiment of the guitar amplifier software on a typical handheld computing device. The typical handheld device is constructed to support physical audio connections designed only for music playback and telephony. It is therefore not possible to mechanically connect an electric guitar and headphones to a handheld computing device without one or more audio connection adapters.

To eliminate the physical connection problem, the exemplary embodiment 500 utilizes mating multi-function connectors 516 and 526. The multi-function connector 526 at an end of an audio coupling cable 520 provides the digital communication means for the handheld computing device 510 and the audio interface integrated circuit.

The audio coupling cable 520 further includes the female stereo audio jack 524 in order to provide the user of the device with headphone capability. The female stereo audio jack 524 includes a three contact output connection for the ground signal, the left stereo signal, and the right stereo signal.

The audio coupling cable 520 further comprises a male instrument plug 522 to provide a connection to the guitar (not illustrated). The male instrument plug 522 includes contact areas for the ground signal 530 and the guitar signal 532.

An input level control 528 may be included as a component of the audio coupling cable 520. The input level control function is sometimes also referred to as "trim".

In an exemplary mode of operation, the multi-function connector 516 mates with multi-function connector 526. The male instrument plug 522 is received in the electric guitar instrument output jack. If the user chooses to not use the speakers 514 of the handheld computing device 510, the user can simply plug standard headphones into the female stereo audio jack 524.

It will be recognized by those skilled in the art that although the audio coupling cable 520 has been described with reference to an electric guitar, the coupling cable 520 could be used with any electric musical instrument that the user wants to connect to a computing device.

Another straightforward modification to the audio coupling cable 520 can be employed if it is presumed that the user will choose to always use a set of headphones. In that case, a pair of standard stereo headphones would be hardwired to the audio coupling cable 520.

Figure 6:
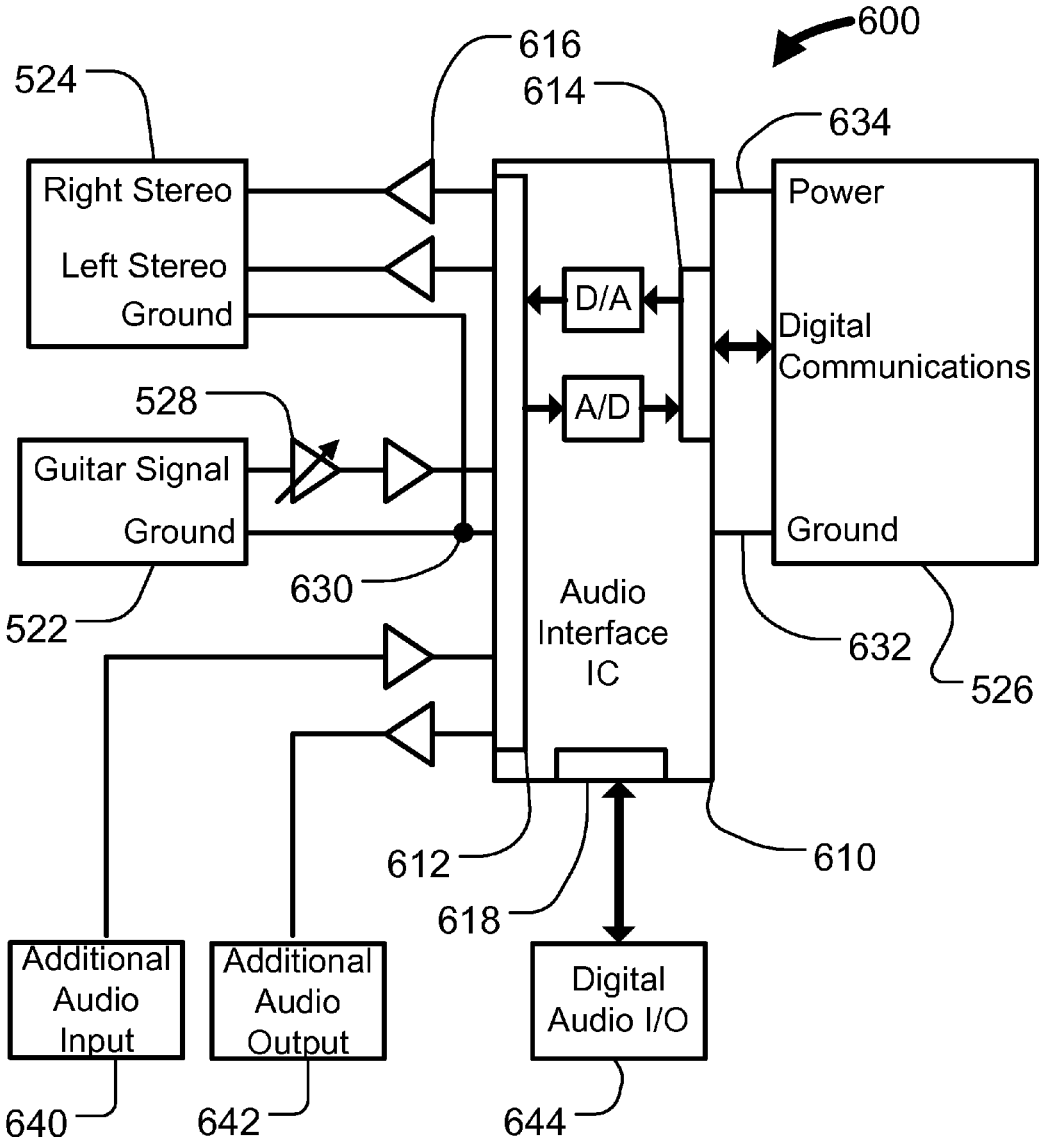
FIG. 6 illustrates a schematic wiring diagram for an exemplary embodiment of the audio coupling cable.

FIG. 6 illustrates a partial schematic wiring diagram for an exemplary wiring design 600 for the audio connection device 520. Wiring design 600 illustrates wiring connections which incorporate an audio interface integrated circuit 610, which may be described as a "coder/decoder" or "codec". The audio interface integrated circuit 610 incorporates an analog to digital (A/D) converter and a digital to analog (D/A) converter connected between an analog audio interface 612, and a digital interface 614. Also included in the circuit are connections to power 634 and to ground 632.

The analog audio interface 612 connects to the guitar signal through the male instrument plug 522 and the stereo audio outputs from the female stereo audio jack 524 using analog buffer circuits 616. The analog buffer circuits 616 may be specified by the manufacturer of the audio interface integrated circuit 610. Depending on the manufacturer, analog buffer circuits 616 may not be required and a direct connection may be possible. The audio interface integrated circuit 610 performs analog to digital conversion of the signal from the guitar received through male instrument plug 522, and digital to analog conversion of the stereo output signals from the female stereo audio jack 524. An optional volume control circuit 528 may be included to implement the instrument level "trim" control.

The audio interface integrated circuit 610 contains a digital interface 614 which performs digital communication of digital audio samples and status/control/configuration data between the audio interface integrated circuit 610 and the central processing unit of the handheld computing device 510. The digital communication is physically transmitted and received using digital signal pins connected through the mating multi-function connectors 516 and 526. Common digital communication methods include, but are not limited to; universal serial bus (USB), pulse code modulation (PCM), time division multiplexing (TDM), inter-integrated sound (I2S), Sony/Philips digital interconnect format (SPDIF), audio codec '97 (AC97), and the general circuit interface (GCI).

For specific electrical implementations, the manufacturer of the audio interface integrated circuit 610 may publish guidelines for the proper handling of the power 634 and ground signals 630 and 632. Specific power supply filters may be employed, and rules for electrical routing of power and ground printed circuit board traces should be followed. Also, it should be noted that some implementations may use more than one physical integrated circuit to implement the described audio interface integrated circuit 610.

The wiring design 600 may be modified by selecting an audio interface integrated circuit 610 that includes an analog interface 612 that is capable of supporting additional audio inputs and outputs. FIG. 6 illustrates this feature with the inclusion of an additional audio input 640 and an additional audio output 642.

Another optional modification to the wiring design 600 is to choose an audio interface integrated circuit 610 with an additional digital interface 618. The additional digital interface 618 may be used to receive a digital audio input/output connector 644. Again, numerous methods exist to provide digital audio communications connections including, but not limited to; universal serial bus (USB), pulse code modulation (PCM), time division multiplexing (TDM), inter-integrated sound (I2S), Sony/Philips digital interconnect format (SPDIF), audio codec '97 (AC97), and the general circuit interface (GCI).

Figure 7:
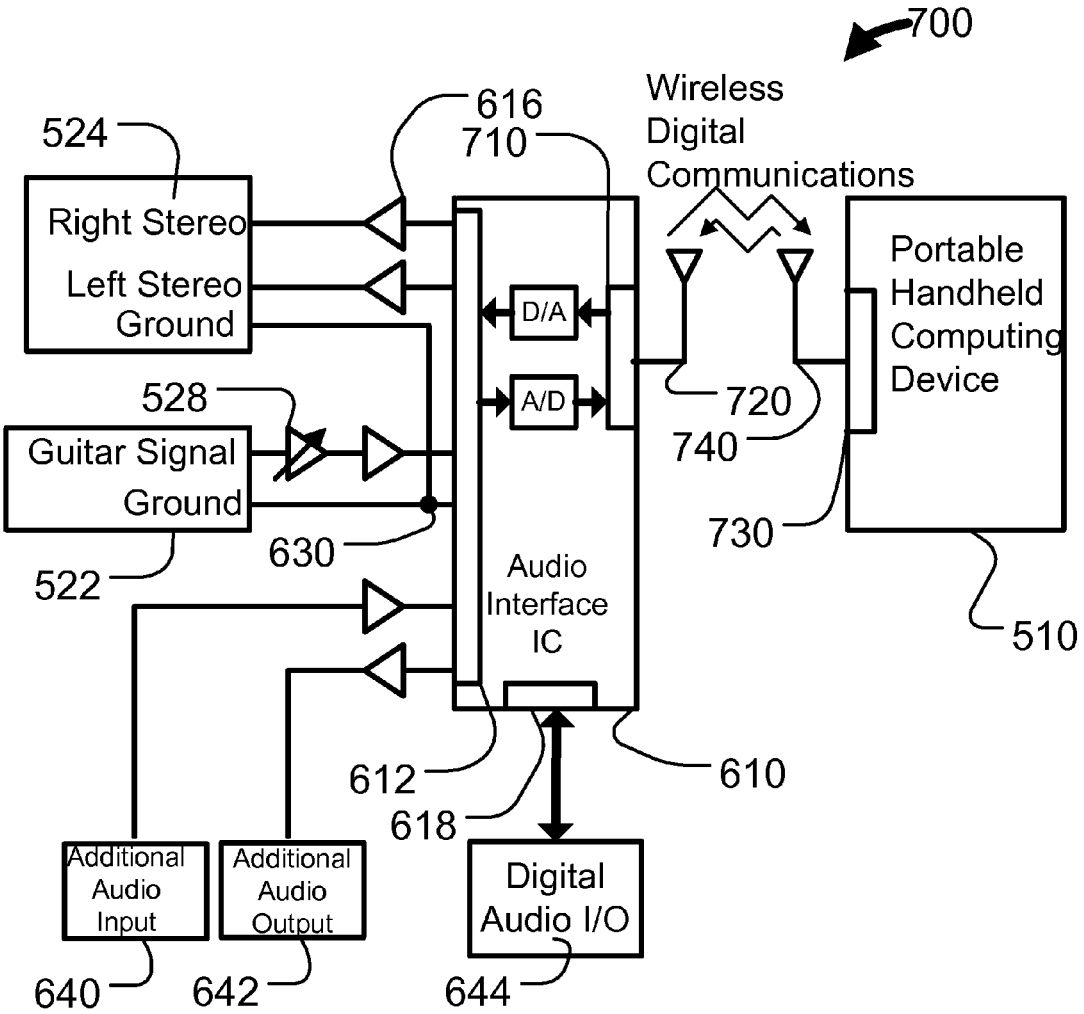
FIG. 7 illustrates a schematic wiring diagram utilizing a wireless digital communication connection.

FIG. 7 illustrates a partial schematic diagram for an optional wiring system for a system 700 that utilizes wireless digital communications. In the wireless system 700, the digital interface 614 and multi-function connector 526 are replaced with a digital wireless transceiver 710 connected to a wireless antenna 720. A second digital wireless transceiver 730 and a second wireless antenna 740 are used in place of the mating multifunction connector 516. Both the second wireless transceiver 730 and the second wireless antenna 740 are coupled to the handheld computing device 510. It should be noted that the second wireless transceiver 730 and the second wireless antenna 740 may be directly connected to the handheld computing device 510, or indirectly coupled to the handheld computing device 510 through an external peripheral port. It will be recognized by those skilled in the art that numerous methods exist to provide wireless digital communications connections, including, but not limited to, Bluetooth IEEE 802.15, and Wireless Local Area Network IEEE 802.11. It should be noted that some implementations may use more than one physical integrated circuit to implement the described audio interface integrated circuit 610, digital wireless transceiver 710, and digital wireless transceiver 730.

While the present invention has been described in connection with a series of preferred embodiments, these descriptions are not intended to limit the scope of the invention to the particular forms set forth herein. It will be understood that the methods of the invention are not necessarily limited to the discrete steps or the order of the steps described. To the contrary, the present descriptions are intended to cover such alternatives, modifications, and equivalents as may be included within the spirit and scope of the invention as defined by the appended claims and otherwise appreciated by one of ordinary skill in the art.

What is claimed is:

1. A method for processing an electric guitar signal, the method comprising:

receiving an analog output of an electric guitar having a high impedance at a buffer amplifier of an audio coupling device, the audio coupling device being disposed between the electric guitar and a portable handheld computing device and including a first connector for coupling the audio coupling device to an interface of the electric guitar, a second connector for coupling the audio coupling device to an interface of the portable handheld computing device, and an analog to digital converter;

providing by the buffer amplifier the analog output of the electric guitar having a low impedance to the analog to digital converter;

converting the analog output of the electric guitar into a digital audio signal using the analog to digital converter;

providing the digital audio signal from the audio coupling device to the portable handheld computing device using digital communications, the portable handheld computing device including a general purpose microprocessor, an operating system, memory; and means for installing and removing software applications; and processing the digital audio signal with digital signal processing steps, the digital signal processing steps performed by a software application downloaded from an applications server to the portable handheld computing device, the software application installed independently from other software contained in memory on the portable handheld computing device, the digital signal processing steps comprising:

receiving the digital audio signal by reading audio samples from the audio driver subsystem of the operating system of the portable handheld computing device;

processing the audio samples using a digital signal processing block to optionally add audio effects selected by the user of the software application; and outputting the processed guitar signal by writing audio samples to the audio driver subsystem of the operating system of the portable handheld computing device.

2. The method of claim 1, wherein the digital communications are wireless communications.

3. The method of claim 1, wherein the audio coupling device is configured to draw power from the portable handheld computing device.

4. The method of claim 1, wherein the audio coupling device requires no adaptive connectors.

5. The method of claim 1, wherein the processing the digital audio signal further includes audio mixing the digital audio signal with digitally encoded music files stored in memory of the portable handheld computing device.

6. The method of claim 1, wherein the digital signal processing block uses digitally encoded music files stored in memory as an alternative input signal.

7. The method of claim 1, wherein user-selectable audio effects include one or more of volume control, vacuum-tube-like distortion, tone control equalization, tone shaping, cabinet simulation, reverb, digital delay, chorus, flanger, phase-shifter, rotating loudspeaker, tremolo, dynamics compression, hum canceller, and noise gate.

8. The method of claim 1 further comprising:

receiving the analog output of the electric guitar having a high impedance at the analog to digital converter.

9. A system for processing an audio signal, the system comprising:

an audio coupling device disposed between an electric guitar and a portable handheld computing device; the audio coupling device including a first connector for coupling the audio coupling device to an interface of the electric guitar, a second connector for coupling the audio coupling device to an interface of the portable handheld computing device, and an analog to digital converter, the analog to digital converter receiving an analog output of an electric guitar, converting the analog output of the electric guitar into a digital audio signal, and providing the digital audio signal from the audio coupling device the portable handheld computing device using digital communications; and a portable handheld computing device including a processor, an operating system, memory, and a mechanism to install and remove software applications, the processor executing instructions stored in memory to process the digital audio signal with digital signal processing steps, the digital signal processing steps performed by a software application downloaded from an application server to the portable handheld computing device, the software application installed independently from other software contained in memory on the portable handheld computing device, the digital signal processing steps comprising:

receiving the digital audio signal by reading audio samples from the audio driver subsystem of the operating system of the portable handheld computing device, processing the audio samples using a digital signal processing block to optionally add audio effects selected by the user of the software application, and providing the processed signal by writing audio samples to the audio driver subsystem of the operating system of the portable handheld computing device;

wherein the audio coupling device further includes a buffer amplifier, the buffer amplifier receiving the analog output of the electric guitar having a high impedance and providing the analog output of the electric guitar having a low impedance to the analog to digital converter.

10. The system of claim 9, wherein the digital communications are wireless communications.

11. The system of claim 9, wherein the audio coupling device is configured to draw power from the portable handheld computing device.

12. The system of claim 9, wherein the audio coupling device requires no adaptive connectors.

13. The system of claim 9, wherein the processor is further configured to execute instructions stored in memory to perform audio mixing of the digital audio signal with digitally encoded music files stored in memory of the portable handheld computing device.

14. The system of claim 9, wherein the processor further executes instructions stored in memory to use digitally encoded music files stored in memory as an alternative input.

15. The system of claim 9, wherein user-selectable effects are added that include one or more of volume control, vacuum-tube-like distortion, tone control equalization, tone shaping, cabinet simulation, reverb, digital delay, chorus, flanger, phase-shifter, rotating loudspeaker, tremolo, dynamics compression, hum canceller, and noise gate.

16. The system of claim 9 wherein the analog to digital converter receives the analog output of the electric guitar having a high impedance.

* * * * *

UNITED STATES PATENT AND TRADEMARK OFFICE

CERTIFICATE OF CORRECTION

PATENT NO. : 8,816,182 B2
APPLICATION NO. : 13/039243
DATED : August 26, 2014
INVENTOR(S) : Kevin Arthur Robertson It is certified that error appears in the above-identified patent and that said Letters Patent is hereby corrected as shown below:

In the Claims,
At Col. 6, Line 65-66: replace "having a high impedance at a buffer amplifier of" with "at"
At Col. 7, Line 7: delete "providing by the buffer amplifier the analog output of the electric guitar having a low impedance to the analog to digital converter;"
At Col. 7, Line 34: replace "device." with "device; wherein the audio coupling device further comprises a buffer amplifier circuit that receives an input signal with a high impedance and generates an output signal with a low impedance."
At Col. 8, Line 32: replace "wherein the audio coupling device further includes a buffer amplifier, the buffer amplifier receiving the analog out-put of the electric guitar having a high impedance and providing the analog output of the electric guitar having a low impedance to the analog to digital converter." with "wherein the audio coupling device comprises a buffer amplifier circuit that receives an input signal with a high impedance and generates an output signal with a low impedance."

Signed and Sealed this
Eleventh Day of November, 2014

Michelle K. Lee

Michelle K. Lee
*Deputy Director of the United States Patent and Trademark Office*